US006758168B2

(12) United States Patent
Koskinen et al.

(10) Patent No.: US 6,758,168 B2
(45) Date of Patent: Jul. 6, 2004

(54) METHOD AND APPARATUS FOR SOOTBLOWING RECOVERY BOILER

(75) Inventors: Jukka Koskinen, Tampere (FI); Mikko Leskinen, Vuorentausta (FI); Jaakko Hanhinen, Tampere (FI)

(73) Assignee: Metso Automation Oy, Helsinki (FI)

( * ) Notice: Subject to any disclaimer, the term of this patent is extended or adjusted under 35 U.S.C. 154(b) by 0 days.

(21) Appl. No.: 10/449,277

(22) Filed: May 30, 2003

(65) Prior Publication Data

US 2003/0205210 A1 Nov. 6, 2003

Related U.S. Application Data

(63) Continuation of application No. PCT/FI01/01042, filed on Nov. 29, 2001.

(30) Foreign Application Priority Data

Nov. 30, 2000 (FI) ..... 20002633

(51) Int. Cl.[7] ..... F22B 37/56

(52) U.S. Cl. ..... 122/7 R; 122/379; 122/392; 15/316.1

(58) Field of Search ..... 122/4 D, 7 R, 122/379–381, 392; 15/315, 316 A; 239/750

(56) References Cited

U.S. PATENT DOCUMENTS

| | | | | |
|---|---|---|---|---|
| 2,948,013 A | | 8/1960 | Bearer, Jr. | |
| 4,454,840 A | | 6/1984 | Dziubakowski | |
| 4,466,383 A | | 8/1984 | Klatt et al. | |
| 4,475,482 A | * | 10/1984 | Moss et al. | 122/379 |
| 4,488,516 A | | 12/1984 | Bueters et al. | |
| 4,552,098 A | | 11/1985 | Wynnyckyj et al. | |
| 4,718,376 A | | 1/1988 | Leroueil et al. | |
| 4,869,209 A | | 9/1989 | Young | |
| 4,996,951 A | | 3/1991 | Archer et al. | |
| 5,181,482 A | | 1/1993 | Labbe et al. | |
| 5,359,967 A | * | 11/1994 | Carter et al. | 122/379 |
| 6,325,025 B1 | * | 12/2001 | Perrone | 122/379 |

FOREIGN PATENT DOCUMENTS

| | | |
|---|---|---|
| DE | 195 02 104 | 7/1996 |
| JP | 8075137 | 3/1996 |
| JP | 11094233 | 4/1999 |
| JP | 11148633 | 6/1999 |

OTHER PUBLICATIONS

Copy of Finnish Official Action for Finnish Priority Appl. No. 2002633 dated May 22, 2001.

Copy of International Search Report for PCT/FI01/01042 completed Mar. 1, 2002.

* cited by examiner

*Primary Examiner*—Gregory Wilson
(74) *Attorney, Agent, or Firm*—Alston & Bird LLP

(57) ABSTRACT

A method and apparatus for sootblowing a recovery boiler. Sootblowers of the recovery boiler are divided into sootblowing groups, and a sootblowing interval is determined for the sootblowers. A fouling index is produced for each sootblowing group of the recovery boiler, and relative frequency values are calculated.

12 Claims, 2 Drawing Sheets

METHOD AND APPARATUS FOR SOOTBLOWING RECOVERY BOILER

CROSS-REFERENCE TO RELATED APPLICATIONS

This application is a Continuation of International Application PCT/F101/01042 filed Nov. 29, 2001, which designated the U.S. and was published under PCT Article 21(2) in English, and which is hereby incorporated herein in its entirety by reference.

BACKGROUND OF THE INVENTION

1) Field of the Invention

The invention relates to a method for sootblowing a recovery boiler, wherein sootblowers of the recovery boiler are divided into sootblowing groups.

The invention further relates to an apparatus for sootblowing a recovery boiler, the apparatus comprising sootblowers arranged in sootblowing groups in the recovery boiler, and a control apparatus.

2) Description of Related Art

In pulp mills, black liquor developed in the course of pulp making is burned in a recovery boiler in order to recover recyclable chemicals and the energy of combustible materials contained in the black liquor. In the recovery boiler, heat is recovered utilizing water tubes that constitute the walls of the recovery boiler and other heat transfer surfaces. Such heat transfer surfaces include superheaters located in a combustion chamber of the recovery boiler and feed water preheaters and boiler banks located in a flue gas passage after the boiler.

When black liquor is burned, considerable amounts of gases, particles, carry over drops and other such combustion by-products emerge that flow through the recovery boiler and the flue gas passage together with combustion gases. Some of the combustion by-products adhere to the heat transfer surfaces, which are thus fouled. Fouling reduces the efficiency of the recovery boiler, since dirt works as an insulating material between the combustion gases and the water to be heated flowing in the tube systems, and steam. In addition, eventually fouling causes clogging, and in order to remove the clogging, the burning process in the recovery boiler has to be stopped. A clogged recovery boiler typically means at least a twenty-four-hour shutdown for the entire production unit, which causes great economic losses for the entire pulp mill.

The heat transfer surfaces of the recovery boiler are sootblown in order to prevent or delay fouling. How often a recovery boiler needs to be sootblown substantially depends on the structure and conditions in the combustion chamber of the recovery boiler, which affect the amount and characteristics of the combustion by-products. It is to be noted that hereinafter in the present invention, unless otherwise indicated, sootblowing a recovery boiler refers to sootblowing both the actual recovery boiler part and the subsequent flue gas passage. Sootblowing is usually carried out using steam, the steam consumption of a sootblowing procedure typically being 4–5 kg/s, which corresponds to about 4–5% of the steam production of the entire recovery boiler; the sootblowing procedure thus consumes a considerably large amount of thermal energy.

At its simplest, sootblowing is a procedure known as sequence sootblowing, wherein sootblowers operate at determined intervals in an order determined by a certain predetermined list. The sootblowing procedure runs at its own pace according to the list, irrespective of whether sootblowing is needed or not, which means that clogging cannot necessarily be prevented even if the sootblowing procedure consumes a high amount of steam.

U.S. Pat. No. 4,718,376 discloses a method comprising assigning the sootblowers into a number of groups, each sootblower being provided with a weight factor which is a percentage of the total time of a sootblowing cycle and which determines the number of sootblowing cycles in which the particular sootblower participates; a sootblowing cycle is the time the sootblowing procedure takes to cover the entire recovery boiler. The weight factor can be modified using data measured from the procedure, such as draft loss increase and heat transfer factor. However, the method is not necessarily fast enough to prevent clogging in some part of the recovery boiler since the sootblowing cycle has to proceed in a predetermined order before a particular part becomes sootblown; therefore, there will be enough time for ash to harden onto the surface of the recovery boiler, after which it is impossible to remove it by sootblowing.

BRIEF SUMMARY OF THE INVENTION

An object of the present invention is to provide a sootblowing method and a sootblowing arrangement that enable the above-mentioned drawbacks to be avoided.

A sootblowing method of the invention is characterized by producing a fouling index for each sootblowing group of the recovery boiler, determining sootblower-specific sootblowing intervals, calculating relative frequency values of the sootblowing groups, selecting, for sootblowing, the sootblowing group and the sootblower such that the sootblowing takes place substantially according to the relative frequency values and the sootblower-specific sootblowing intervals.

A sootblowing apparatus of the invention is characterized in that the control apparatus is arranged to determine sootblower-specific sootblowing intervals, produce a fouling index for each sootblowing group and calculate relative frequency values for the sootblowing groups, select, for sootblowing, the sootblowing group and the sootblower such that the sootblowing takes place substantially according to the relative frequency values and the sootblower-specific sootblowing intervals.

The basic idea of the invention comprises determining sootblower-specific sootblowing intervals; producing a fouling index for each sootblowing group of the recovery boiler to describe the susceptibility to fouling of a part of a particular recovery boiler and correcting the sootblowing interval of the sootblowing groups by utilizing the fouling index; calculating the relative frequency values of the sootblowing group to describe the relative proportion of the sootblowing time of each sootblowing group from the sum of the sootblowing times of all sootblowing groups of the particular recovery boiler; selecting, for the sootblowing procedure, the sootblowing group and the sootblower such that the sootblowing procedure substantially takes place according to the relative frequency values and the sootblower-specific sootblowing intervals. Furthermore, the idea underlying a preferred embodiment comprises producing importance counters for each sootblowing group, the value of the importance counters being increased by the relative frequency value of the sootblowing group after each sootblowing procedure, and, in addition, if the sootblowing procedure has taken place in a sootblowing group of its own, reducing the value of the importance counter by one; selecting, for the sootblowing procedure, the sootblower whose sootblowing time, i.e. the time passed from the start of its previous sootblowing procedure, most exceeds the desired sootblowing interval or whose sootblowing time from its previous sootblowing procedure comes closest to the sootblowing interval calculated for the particular sootblower, and which sootblower belongs to the sootblowing group having the highest importance counter value. Furthermore, the idea of a second preferred embodiment comprises correcting the sootblowing interval of the sootblower by applying the fouling index and the formula $$\text{sootblowing interval} = \text{starting interval} - \text{fouling index} \times \text{maximum correction}$$

Furthermore, the idea of a third preferred embodiment comprises adjusting the starting interval of the sootblowers such that the sootblowing interval of the most important sootblowers of the sootblowing group becomes shorter and the starting interval of the less important sootblowers becomes longer while the total time used by the sootblowing group remains unchanged. The idea of yet a fourth preferred embodiment comprises determining the fouling index by fuzzy logic.

An advantage of the invention is that it enables the sootblowing resources to be targeted at critical spots in the boiler for maximum benefit. The recovery boiler is sootblown as evenly as possible, leaving no recovery boiler part unblown for too long, thus preventing ash from hardening. In addition, the conditions in the recovery boiler enable optimal consumption of sootblowing steam.

In the present application, the term 'sootblower' may also refer to a pair of sootblowers.

BRIEF DESCRIPTION OF THE SEVERAL VIEWS OF THE DRAWINGS

The invention will be described in closer detail in the accompanying drawings, in which FIG. 1 schematically shows a typical, partially sectioned recovery boiler to which a method and an apparatus of the invention are applied, and FIG. 2 schematically shows an embodiment of the sootblowing method of the invention.

DETAILED DESCRIPTION OF THE INVENTION

Figure 1:
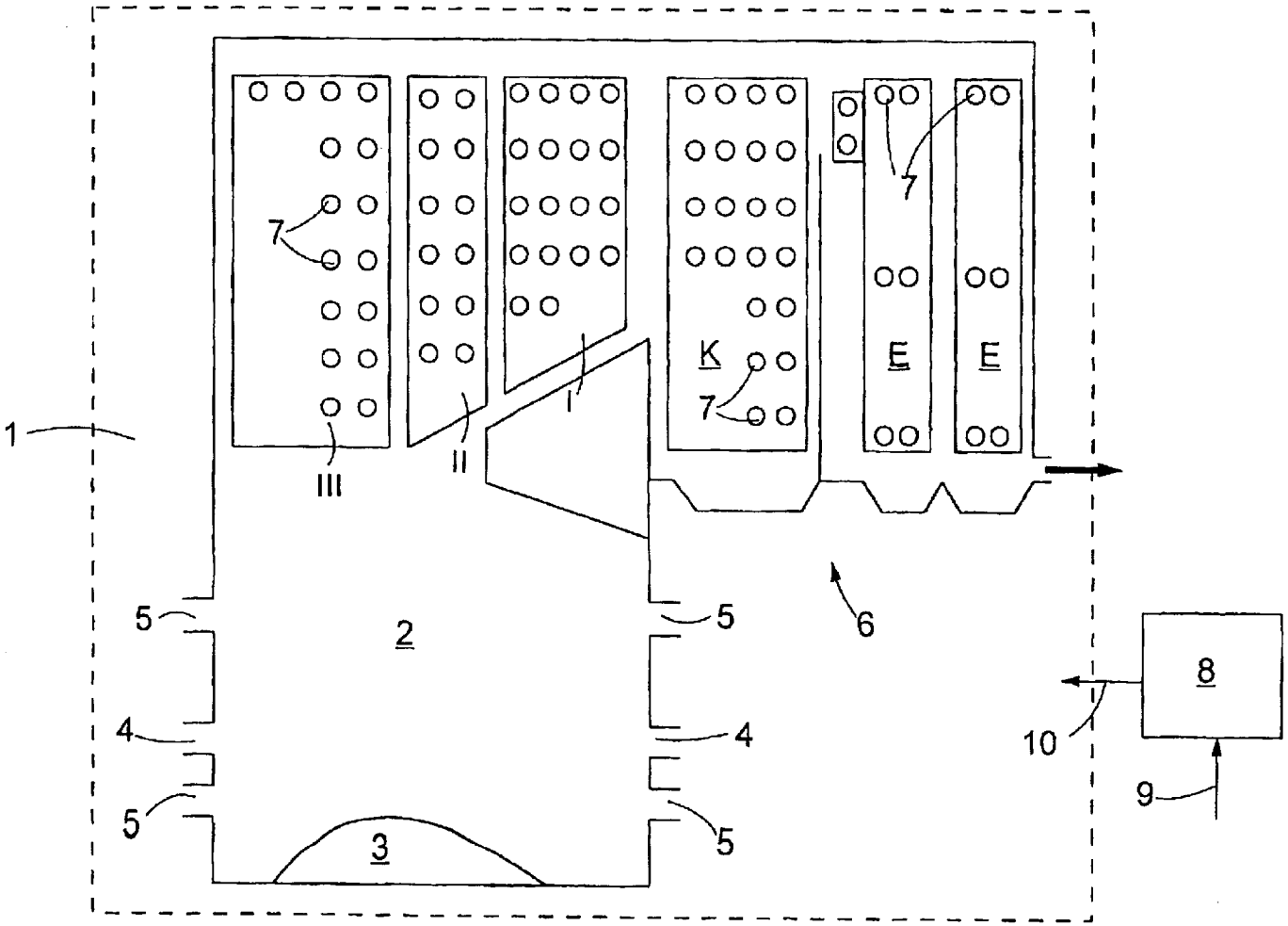

FIG. 1 schematically shows a typical, partially sectioned recovery boiler 1 to which a method and an apparatus of the invention are applied. At the bottom of a combustion chamber 2 lies a bed 3, which is provided therein when the recovery boiler is in operation. The walls of the combustion chamber 2 are provided with liquor nozzles 4 for feeding black liquor to the recovery boiler to be burned, and air nozzles 5 presented schematically at several different heights in the vertical direction of the recovery boiler for feeding and distributing combustion air into the recovery boiler through the air nozzles in a manner known per se in order to ensure as effective combustion as possible, causing as low harmful emissions as possible. The operation of the recovery boiler per se, liquor and air feed and air distribution are generally known per se to one skilled in the art; therefore, being irrelevant to the actual invention, they will not be described in closer detail herein.

The combustion chamber 2 is followed by a flue gas passage 6, which receives the flue gases flowing out of the recovery boiler. Typically, the flue gas passage 6 comprises a first passage located after the combustion chamber such that the flue gas being discharged from the combustion chamber flows downwards in the vertical direction in the first passage, and then upwards. Typically, after the first passage there is provided a second vertical passage into which the flue gases flowing from the lower end of the first passage are supplied, now flowing upwards in the vertical direction in the second passage. Typically, the flue gas passage 6 further comprises a third vertical passage located after the second passage such that the flue gas flowing from the second passage turns to flow downwards in the vertical direction in the third passage. After the third passage, the flue gas exits, typically being further processed. The flowing of the flue gases and the way they travel through the procedure are known per se to one skilled in the art; therefore, they will not be described in closer detail herein.

The upper part of the combustion chamber 2 comprises superheaters 7, which are designated by numbers I to III. Superheaters are generally provided with certain names; in the case shown in the figure, number I is usually called a primary superheater, number II a secondary superheater and number III a tertiary superheater. Consecutive numbers are assigned to the superheaters because when superheated steam is to be produced, the steam produced from water in the tubes of the recovery boiler is conveyed through the superheaters, heating it to a temperature of several hundreds of degrees. In order to carry out this in a desired manner, the steam is conveyed to a primary superheater located in flue gas having a lower temperature, and further to a secondary superheater and a tertiary superheater and, eventually, out of the system for further use. The heat of the flue gases is thus recovered as efficiently as possible when the hottest flue gas heats the steam at the last stage while the flue that gas is cooling down heats the steam having a lower temperature in the secondary and primary superheaters. The figure shows a side view of the superheaters, so it seems like there were only one superheater tube system. In practice, the superheater comprises several parallel tube systems to make the flue gases flow in between the tube system, heating the tubes. Similarly, several parallel superheater units may be provided in the cross direction of the recovery boiler. All this is generally widely known per se, being obvious to one skilled in the art; therefore, it does not need to be described in closer detail herein. The first flue gas passage comprises a boiler bank K for heating water into steam. The second flue gas passage and the third flue gas passage comprise a heat recovery member E, i.e. an 'economizer', which, utilizing the already rather cooled flue gases, preheats the water to be fed into the recovery boiler in order to improve the heat recovery characteristics. The usage of such economizers and the positioning thereof in flue gas passages are common and widely known per se, being obvious to one skilled in the art; therefore, it will not be necessary to describe this in closer detail herein. In the third flue gas passage, the flue gases again flow downwards in the vertical direction, to be removed from the lower end of the flue gas passage into a discharge channel in a manner known per se.

Typically having the shape of long steam tubes or steam channels, sootblowers 7 are arranged in connection with the heat transfer surfaces, the sootblowers penetrating into the combustion chamber or flue gas passage from openings in the wall of the boiler, continually blowing steam during sootblowing and withdrawing therefrom when the sootblowing is completed. In the present application, the term 'sootblower' refers either to a single sootblower or to a pair of sootblowers wherein the sootblowers are arranged to face one another on opposite sides of the recovery boiler, substantially on the same line. The sootblowers, sootblower pairs and their operation represent the prior art to one skilled in the art; therefore, they are not described in closer detail in the present application.

The operation of the sootblowers 7 is based on steam, which is allowed onto the surface to be sootblown through a sootblower. It is to be noted herein that although in the present application sootblowing is shown to be carried out using steam, the invention is not restricted thereto but the operation of the sootblowers may also be based on another principle, such as acoustic sootblowing or another principle enabling sootblowing while the recovery boiler is being used.

Eighteen sootblowers 7 are arranged in connection with the primary superheater I, twelve sootblowers in connection with the secondary superheater II and sixteen sootblowers in connection with the tertiary superheater III, twenty-two sootblowers are arranged on the boiler bank and a total of fourteen sootblowers in connection with the preheaters. Naturally, the location and number of sootblowers 7 vary boiler-specifically; the recovery boiler shown in FIG. 1 is only one example showing how the sootblowers might be positioned.

The boiler comprises a sootblowing apparatus comprising, in addition to the sootblowers 7, a control apparatus 8. The control apparatus 8 receives information 9 e.g. about whether the recovery boiler needs to be sootblown and the operation and condition of the sootblowers, the operation of the sootblowers 7 being controlled by control information or commands 10 given by the control apparatus 8. The formation of the sootblowing control information 10 will be described in closer detail in connection with FIG. 2.

Figure 2:
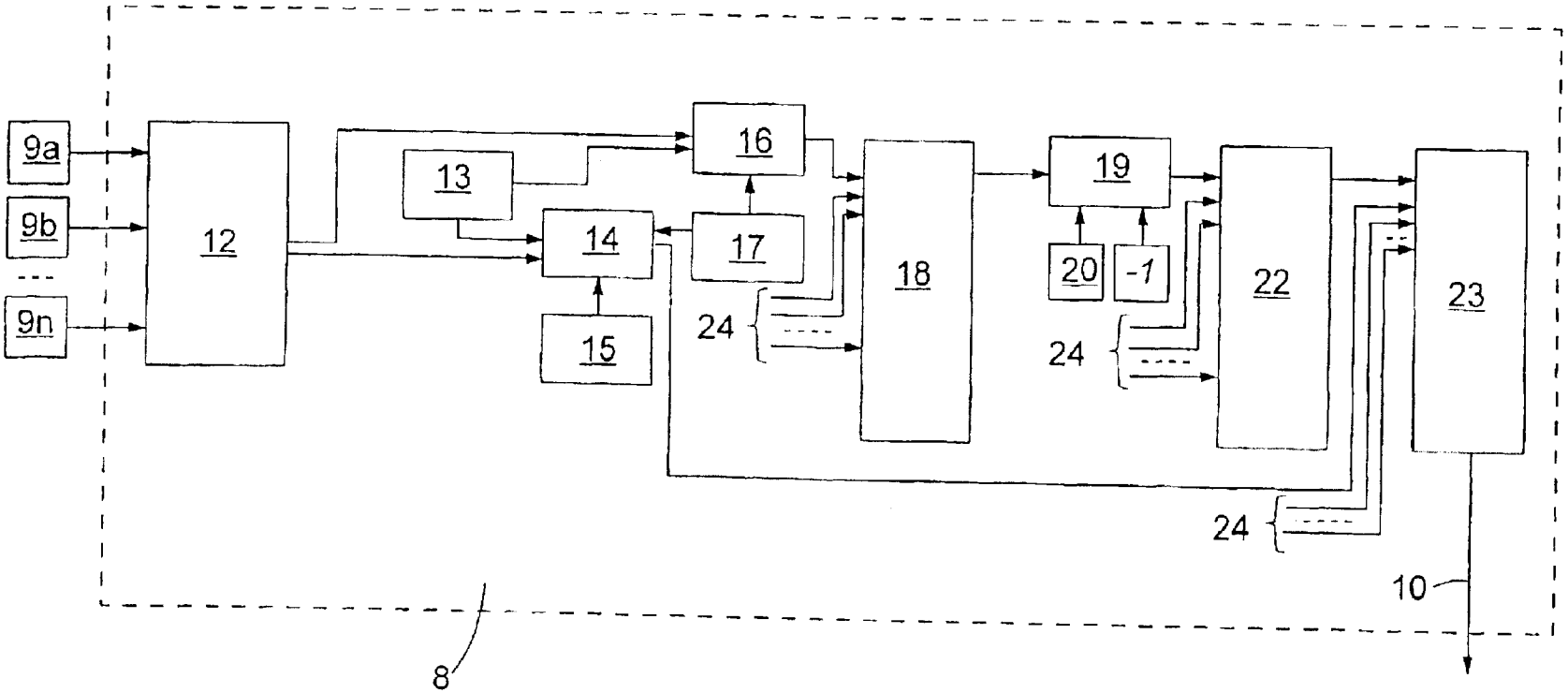

FIG. 2 schematically shows an embodiment of the sootblowing method of the invention. The recovery boiler is divided into sootblowing groups, e.g. into the following six sootblowing groups: EKO1 and EKO2, i.e. a first preheater sootblowing group and a second preheater sootblowing group; KP, i.e. a boiler bank sootblowing group; TUL1, TUL2 and TUL3, i.e. a primary superheater sootblowing group, a secondary superheater sootblowing group and a tertiary superheater sootblowing group. The number of sootblowing groups and the manner in which they are divided into groups may naturally differ from the shown one. In practice, it is often the number of measuring points of measurement devices measuring the conditions of the recovery boiler that determines the number of sootblowing groups. FIG. 2 thoroughly describes only the first preheater sootblowing group EKO1 of the control apparatus 8; the rest of the sootblowing groups EKO2, KP, TUL1, TUL2, TUL3 comprise similar method steps.

In step 12, each sootblowing group EKO1, EKO2, KP, TUL1, TUL2, TUL3 is provided with a boiler-part-specific fouling index L, i.e. fouling indices $L_{EKO1}$, $L_{EKO2}$, $L_{KP}$, $L_{TUL1}$, $L_{TUL2}$ and $L_{TUL3}$ are produced. When producing the fouling index L, the heat transfer factor of the boiler part, draft loss, temporary $SO_2$ level, flue gas temperature after superheaters, long-term change in heat transfer factor and long-term change in draft loss, for instance, are taken into account, the measured or calculated variables being designated by numbers 9*a* to 9*n* in FIG. 2. The variables are measured and produced in manners known per se, so they will not be discussed in closer detail herein.

The fouling index L presents the sootblowing need of the particular boiler part, the value range of the fouling index being [−1, +1] in the present embodiment, in which case a fouling index 0 refers to a normal need for sootblowing, a value approaching +1 refers to a sootblowing need greater than normal, and a value approaching −1 refers to a sootblowing need smaller than normal. The control apparatus 8 continually calculates fouling indices at a separately determined frequency. Step 12 determining the fouling index L is implemented by a calculation program based e.g. on fuzzy logic.

In method step 13, sootblowers 7 belonging to a particular sootblowing group, their starting interval F, sootblowing steam pressure and operating speed and possibly other such information are determined for each sootblowing group. The starting interval F is experimentally determined, manually set time between two successive starts of a sootblower. The boiler-part-specific fouling index L determined in the calculation 12 is used for correcting the time between two successive starts of the sootblower, applying the formula $$N=F-L\times K_{max},$$

wherein N=sootblowing interval, which is the actual starting interval of the sootblower taking place after all corrections carried out by the apparatus, i.e. the time between two successive sootblower starts of the sootblower, F=starting interval and $K_{max}$=magnitude of maximum correction, which now equals the maximum value of the fouling index L, i.e. +1. The sootblowing interval N, which has not been changed by the control apparatus 8, is thus as long as the starting interval F. The control apparatus 8 continually calculates the sootblowing interval N of each sootblowing group at a separately determined frequency.

On the basis of the sootblowing interval N, the sootblowing group determination 13 and a sootblower efficiency 17, the sum of the sootblowing times of the sootblowers 7 belonging to a particular group within a given time unit, e.g. twenty-four hours, is calculated for each sootblowing group in step 16. Furthermore, on the basis of the sum of the sootblowing times of the sootblowers 7 belonging to the particular group and the sums of the sootblowing times of the sootblowers 7 of all sootblowing groups, the relative frequency values of the sootblowing groups are calculated in step 18 in the following manner:

$$Frek_x=T_x/T_{tot},$$

wherein $Frek_x$=relative frequency value of sootblowing group X, $T_x$=sootblowing time of sootblowing group X, and $T_{tot}$=sum of the sootblowing times of all sootblowing groups. Reference number 24 designates information supplied from the sootblowing groups EKO2, KP, TUL1, TUL2, TUL3, formed in a similar manner to the information supplied to the same method step from EKO1.

The sootblowing time $T_x$ is thus the time taken to run the sootblowing procedures of all sootblowers 7 in the particular sootblowing group. For instance, if the sootblowing group comprises two sootblowers 7, one of which carries out the sootblowing procedure five times in twenty-four hours and the other three times in twenty-four hours, the length of one sootblowing procedure being five minutes, the sootblowing time is $T_x$=40 min. If the sum $T_{tot}$ of all sootblowing times is <24h, there will be free time in a day to be divided between all sootblowing procedures. The free time is divided such that using starting delays of the sootblowers, the control apparatus 8 divides the free time evenly over the entire twenty-four hours. The sootblowing is thus carried out evenly during twenty-four hours, leaving no boiler part unblown for too long, which means that ash is prevented from hardening onto the surfaces of the recovery boiler. As the boiler becomes fouled, the free time decreases and the starting delays become shorter, resulting in an increase in steam consumption; similarly, as the recovery boiler becomes cleaner, the free time increases and the starting delays grow longer, resulting in a reduction in steam consumption. If the sum $T_{tot}$ of all sootblowing times is >24h, there is no free time in a day, nor do the sootblowing procedures have any starting delays. In such a case, the sootblowing time is divided such that the mutual relationships between the sootblowing times of the sootblowing groups, i.e. $Frek_x$, remain unchanged, in other words the profile of the sootblowing procedure remains unchanged. The sootblowing profile is determined in step 18.

Furthermore, each sootblowing group comprises an importance counter 19, whose value is increased applying a formula 20 by a value to be calculated after every sootblowing procedure in the following manner:

$$(\text{new value})_x=(\text{old value})_x+Frek_x.$$

In addition, if the sootblowing procedure has taken place in a sootblowing group of its own, the value of the counter is reduced by one unit. In step 22, the sootblowing group whose importance counter 19 presents the highest value is selected for the sootblowing procedure.

General empirical data exists about how often the different parts of a recovery boiler should be sootblown and about the starting interval and operating time of the sootblowers 7. Based on this information, the operating time per time unit, e.g. twenty-four hours, and the starting interval F have been manually preset for the sootblowers 7 in the sootblowing group in step 13. On the basis of the measurement information obtained from the recovery boiler in step 12, such as the heat transfer factor, draft loss, temporary $SO_2$ level, flue gas temperature, heat transfer factor and long-term changes in the draft loss, the control apparatus 8 concludes whether some part of the recovery boiler starts becoming dirty. If so, in a preferred embodiment of the invention, the sootblowing apparatus adjusts itself such that the sootblowers 7 in the fouling parts of the boiler are given more capacity, in other words the sootblowing interval N of these sootblowers is shortened. Capacity is taken from less important sootblowers 7 of the same sootblowing group, i.e. the sootblowing interval N of such sootblowers is increased. In other words, the control apparatus 8 continually follows the importance of the sootblowers 7 of the sootblowing groups according to their cleaning efficiency and, in step 14, makes a decision about the most important sootblower 7 of each sootblowing group. The efficiency 17 of the sootblower is also taken into account. The control apparatus 8 adjusts the manually set starting intervals F into sootblowing intervals N such that the total sootblowing time taken by the sootblowing group remains unchanged.

Sootblower frequency calculation 15 registers each sootblower's sootblowing procedures and the points in time at which they were performed; this information is used for determining the actual sootblowing interval of the sootblower.

The most important sootblower of the sootblowing group is selected for the sootblowing procedure. The most important sootblower is determined in step 14 and it is a sootblower whose sootblowing time from its previous sootblowing has most exceeded the desired sootblowing interval N. If the desired sootblowing intervals N are not exceeded, the sootblower 7 whose sootblowing time from its previous sootblowing comes closest to the sootblowing interval N determined for it is put to use.

The decision about the sootblower 7 to carry out the sootblowing procedure is made in method step 23. The decision is based on the information received from step 22, which determines the most important sootblowing group and from step 14 determining the most important sootblower 7 of the sootblowing group. On account of the sootblowing decision, the selected sootblower is given a sootblowing command 10.

If, on the basis of the measurements obtained from the boiler, the control apparatus 8 concludes that the boiler is not becoming fouled but stays clean at the sootblowing group in the boiler, the control apparatus starts increasing the sootblowing interval N until a boiler part starts getting fouled, in which case the process returns to the resource dividing step described above. This enables unnecessary consumption of steam and the heat energy therein to be avoided during the sootblowing procedure.

The drawings and the related description are only intended to illustrate the idea of the invention. In its details, the invention may vary within the scope of the claims. Particularly important critical sootblowers can thus be specified whose sootblowing areas are particularly easily clogged on account of the structure of the recovery boiler. Such areas include e.g. points at which the flow rate of the flue gases slows down or the flow changes its direction. Normally, the sootblowing procedure takes place sootblower-specifically at even intervals, as described in connection with FIGS. 1 and 2. In a critical situation, the critical sootblowers of the boiler part are sootblown, after which the process returns to normal sootblowing. The specification of the critical sootblowers can be changed when the conditions in the recovery boiler change. The apparatus may also enable criterion sootblowing wherein only the most important sootblowers are used for the sootblowing procedure. The criterion sootblowing is a separate, additional run of the sootblowing procedure, which is ignored in running the sootblowing groups; nor does running the criterion sootblowing procedure affect the values of the importance counter 19. After the criterion sootblowing, the process returns to normal sootblowing. The range of the fouling index L, the maximum correction $K_x$ and the reduction of the importance counter unit in its own group may differ from that shown above. The invention may also be applied to only some of the sootblowers of the recovery boiler while the control of the rest of the sootblowers of the recovery boiler operate in another known manner. The control unit can be implemented e.g. by a PC, programmable logic or an automation system.

That which is claimed:

1. A method for sootblowing a recovery boiler, comprising dividing sootblowers of the recovery boiler into sootblowing groups, producing a fouling index for each sootblowing group of the recovery boiler, determining sootblower-specific sootblowing intervals, calculating relative frequency values of the sootblowing groups, selecting, for sootblowing, the sootblowing group and the sootblower such that the sootblowing takes place substantially according to the relative frequency values and the sootblower-specific sootblowing intervals.

2. A method as claimed in claim 1, wherein importance counters for each sootblowing group are produced, the value of the importance counters being increased by a number of units indicated by the relative frequency value of the sootblowing group after each sootblowing, and, in addition, if the sootblowing has taken place in a sootblowing group of its own, the value of the importance counter by one unit is reduced, and for the sootblowing, the sootblower from the sootblowing group having the highest importance counter value is selected.

3. A method as claimed in claim 1, wherein for the sootblowing is selected the sootblower whose sootblowing time, i.e. the time passed from the start of its previous sootblowing, most exceeds the sootblowing interval determined for said sootblower or whose sootblowing time, i.e. the time passed from the start of its previous sootblowing, comes closest to the sootblowing interval determined for said sootblower.

4. A method as claimed in claim 1, wherein the time between two successive starts of each sootblower is corrected using the fouling index (L) and the following formula:

$$N=F-L\times K_{max},$$

wherein N=sootblowing interval, F=starting interval and $K_{max}$=magnitude of maximum correction.

5. A method as claimed in claim 1, wherein the starting interval of the sootblowers is adjusted such that the sootblowing interval of the most important sootblowers in the sootblowing group becomes shorter and the sootblowing interval of the less important sootblowers becomes longer while the total time used by the sootblowing group remains unchanged.

6. A method as claimed in claim 1, wherein the fouling index is determined by fuzzy logic.

7. A method as claimed in claim 1, wherein for the sootblowers is determined the free time left from all sootblowing procedures carried out by the sootblowers, the determined free time is divided as starting delays of the sootblowers between all sootblowing procedures.

8. A sootblowing apparatus for a recovery boiler, the apparatus comprising sootblowers arranged in sootblowing groups in the recovery boiler, each sootblowing group having a fouling index, and a control apparatus, wherein the control apparatus comprises:

means for determining sootblower-specific sootblowing intervals, means for calculating relative frequency values for the sootblowing groups, and means for selecting, for sootblowing, the sootblowing group and the sootblower such that the sootblowing takes place substantially according to the relative frequency values and the sootblower-specific sootblowing intervals.

9. A sootblowing apparatus as claimed in claim 8, wherein the control apparatus comprises:

means for producing importance counters for each sootblowing group, the value of the importance counters being increased by a number of units indicated by the relative frequency value of the sootblowing group after each sootblowing, and, in addition, if the sootblowing has taken place in a sootblowing group of its own, reducing the value of the importance counter by one unit, and, wherein said selecting means selects, for the sootblowing, the sootblower from the sootblowing group having the highest importance counter value.

10. A sootblowing apparatus as claimed in claim 8, wherein the control apparatus comprises:

means for selecting, for the sootblowing, the sootblower whose sootblowing time, representing the time passed from the start of its previous sootblowing, most exceeds the sootblowing time determined for said sootblower or whose sootblowing time, representing the time passed from the start of its previous sootblowing, comes closest to the sootblowing interval determined for said sootblower.

11. An apparatus as claimed in claim 8, wherein the control apparatus comprises fuzzy logic.

12. An apparatus as claimed in claim 8, wherein the control apparatus comprises:

means for adjusting the starting interval of the sootblowers such that the sootblowing interval of the most important sootblowers in the sootblowing group becomes shorter and the sootblowing interval of the less important sootblowers becomes longer while the total time used by the sootblowing group remains unchanged.

* * * * *